United States Patent [19]

Lawrence

[11] Patent Number: 4,629,128

[45] Date of Patent: Dec. 16, 1986

[54] APPARATUS FOR CLEANING CLOGGED DRAIN LINES

[75] Inventor: Bobby L. Lawrence, West Harrison, Ind.

[73] Assignee: The Scott & Fetzer Company, Lakewood, Ohio

[21] Appl. No.: 745,430

[22] Filed: Jun. 17, 1985

[51] Int. Cl.[4] ..... B05B 9/01

[52] U.S. Cl. ..... 239/526; 91/417 R; 134/166 R

[58] Field of Search ..... 239/526–528, 239/532, 289, 525; 134/166 C; 4/255–257; 91/417 R, 235, 321, 394, 395, 396; 15/341

[56] References Cited

U.S. PATENT DOCUMENTS

| | | | |
|---|---|---|---|
| 2,445,163 | 7/1948 | Williamson | 137/139 |
| 2,627,873 | 2/1953 | Bothe | 137/652 |
| 2,861,560 | 11/1958 | Alinari | 124/13 |
| 3,055,629 | 9/1962 | Jurs et al. | 251/25 |
| 3,084,672 | 4/1963 | Dalton | 91/417 R |
| 3,087,162 | 4/1963 | Saurenman et al. | 1/343 |
| 3,170,487 | 2/1965 | Juilfs et al. | 137/625.6 |
| 3,255,674 | 6/1966 | Nelson et al. | 91/417 R |
| 3,426,774 | 2/1969 | Conn | 134/166 |
| 3,527,142 | 9/1970 | Obergfell | 91/461 |
| 3,633,459 | 1/1972 | Wilfried | 91/417 R |
| 3,789,861 | 2/1974 | Conn et al. | 134/166 C |
| 3,815,475 | 6/1974 | Howard et al. | 91/399 |
| 3,879,771 | 4/1975 | Nakane | 4/255 |
| 4,030,666 | 6/1977 | Gagliardo | 239/526 |
| 4,033,666 | 6/1977 | Gagliardo | 239/526 |
| 4,097,937 | 7/1978 | Hofmann | 4/255 |
| 4,292,706 | 10/1981 | Fortune | 15/341 |

FOREIGN PATENT DOCUMENTS

| | | | |
|---|---|---|---|
| 2417347 | 10/1979 | France | 4/255 |

*Primary Examiner*—Andres Kashnikow
*Assistant Examiner*—Scott D. Malpede
*Attorney, Agent, or Firm*—Wood, Herron & Evans

[57] ABSTRACT

An apparatus for discharging a high pressure burst of air against a column of standing water behind an obstruction in a drain line to create shockwaves in the water column to remove the obstruction, including a hollow gun body having a discharge opening and a pistol grip handle connected to the gun body. A discharge valve is connected to a piston dividing the interior of the gun body into two chambers, the pressurization and de-pressurization of which is controlled by a trigger operated pilot valve. Air is quickly exhausted from a rearward chamber by depressing the trigger and pilot valve, causing the piston and valve to snap rearwardly to open the discharge opening and direct a burst of pressurized air from a forward chamber to exit through the discharge opening and into a drain line.

12 Claims, 2 Drawing Figures

APPARATUS FOR CLEANING CLOGGED DRAIN LINES

BACKGROUND OF THE INVENTION

This invention relates to apparatus for clearing clogged drain lines, and, more particularly, to an apparatus operable to direct a burst of pressurized air against the column of water behind an obstruction in a clogged drain line to generate a shockwave in the water and dislodge the obstruction.

Numerous devices have been proposed for the removal of obstructions from drain and plumbing lines in which an impulse of pressurized air is applied to the column of standing water behind the obstruction to generate a shockwave in the water to dislodge the obstruction. Devices of this type generally include a housing having a chamber formed with a discharge opening which is adapted to communicate with the drain line to be cleared. A valve, usually in the form of a plunger or piston, is movable within the chamber between a position where it seals the discharge opening to permit pressurization of the chamber, and an exhaust position where its seal with the discharge opening is broken to release the pressurized air from the chamber and into the clogged drain line. Devices of this general type are shown, for example, in U.S. Pat. Nos. 3,426,774; 3,789,861; 3,879,771 and 4,097,937.

One of the disadvantages of the drain cleaning devices disclosed in the patents mentioned above is that the means provided to effect the release of pressurized air from the chamber is inefficient and often difficult to operate. For example, in U.S. Pat. No. 3,426,774 to Conn, the discharge opening of the chamber is opened and closed by a valve mounted at the end of a plunger which is retractable by depressing a trigger mechanically connected to the plunger by a rack and pinion. The valve is normally biased by a spring in a closed position against the discharge opening to permit pressurization of the chamber in preparation for the release of an impulse of air. In order to release fluid from the chamber, the plunger is retracted by depressing the trigger to unseat the valve and open the discharge opening. Retraction of the plunger to an open position requires a relatively large force to be applied on the trigger because the force exerted against the valve by the pressurized fluid and the spring both act in the opposite direction urging the valve against the discharge opening.

Devices of the type described above, which provide a release or trigger mechanism mechanically connected to the piston or plunger to be retracted, are difficult to operate and inefficient. The relatively large force required to depress the trigger mechanism in order to retract the plunger makes it difficult to depress the trigger quickly. If the valve which seals the discharge opening in the chamber is retracted slowly, the pressurized air begins to leak out of the chamber before the trigger is completely depressed, resulting in a gradual pressure drop in the chamber rather than an immediate pressure drop. In order for devices of this type to achieve maximum efficiency, it is necessary to release a high pressure impulse or burst of air against the water column behind the obstruction to obtain effective shockwaves in the water to unclog the drain line. A gradual release of pressurized air from the chamber due to a slowly retracted piston or valve produces a lower pressure, less effective impulse of air.

Another problem with drain cleaning devices of the type described above is that the cross section of the discharge opening in the chambers is often relatively small compared to the diameter of the drain line to be unclogged. This reduces the overall force of the air impulse applied to the standing column of water behind the obstruction and limits the effectiveness of the shockwaves intended to remove the obstruction.

Many drain cleaning devices of the type described above are relatively expensive to manufacture because they are fabricated with several parts which require machining. In addition, many prior art devices are relatively long and bulky which presents a problem in their use for some applications where the openings to the drain line are in a restricted space, such as the drain in a sink having a faucet mounted in a fixed position above the drain.

SUMMARY OF THE INVENTION

It is therefore among the objects of this invention to provide an improved apparatus for removing obstructions from drain and plumbing lines with a high energy impulse or burst of air applied to the column of water behind the obstruction.

A further objective of the invention has been to provide a drain cleaning apparatus which requires very little force to operate, which is fast-acting to ensure the release of a high pressure, drain clearing, impulse of air, which has a discharge opening having a large diameter compared to the diameter of the clogged drain line to be cleaned, which is short and compact so as to be useful in applications having space limitations, which includes molded parts requiring no machining and which is relatively inexpensive to manufacture and assemble.

A further objective of the invention has been to provide an improved triggering apparatus for a drain cleaning gun.

To these ends, a drain cleaning apparatus according to this invention includes an improved discharges valve and a triggering valve therefor. The apparatus preferably includes a hollow housing or body and a retractable piston therein. The piston has a discharge valve at one end operable to seal a discharge opening formed in the forward end of the body, and a head at the other end which engages the inner wall of the body and divides it into forward and rearward chambers. A trigger or pilot valve means controls the flow of pressurized, operating air into the forward and rearward chambers. In a non-operating position with the trigger valve extended, pressurized air is directed into both the forward and rearward chambers on either side of the piston head. Drain cleaning air pressure builds forward of the piston and behind the discharge valve. The parameters of the piston and discharge valve are fixed so that the valve at the forward end of the piston rod moves forwardly and closes the discharge opening. When the trigger is depressed, air pressure rearwardly of the piston is released and the trigger valve means is moved to a position where it is operable to exhaust the pressurized air from the rearward chamber behind the piston head while maintaining pressure in the forward chamber. This pressure differential between the forward and rearward chambers snaps the piston rearwardly to quickly unseat the valve from the discharge opening and immediately release pressurized air from the forward chamber out of the discharge opening and into the drain line to be cleared.

More specifically, the apparatus of this invention is formed in the shape of a gun having a hollow gun body with a forward open end and a rear end provided with a pistol grip handle. A cap having a nozzle including a discharge opening for the release of pressurized air from the gun body and into a drain line is fixed on the open end of the gun body. Movable within the gun body is a piston having a head connected to a stem or rod which extends axially to the forward end of the gun body. The piston rod is connected to a discharge valve at its forward end which is adapted to seat within the nozzle and seal its discharge opening. The piston head engages the interior wall of the gun body to form a rearward chamber behind the piston head, and a forward chamber on the opposite side of the piston head in which the piston rod and valve are disposed.

A pilot valve, operated by a manually engageable trigger, controls the supply of pressurized air to the gun body and is slidably mounted in a transverse bore formed in the handle. The pilot valve includes an interior passageway having inlet and outlet ports, and a series of spaced ribs on its exterior surface which seal against the interior wall formed in the handle by the transverse bore. The pilot valve communicates with a first inlet passageway extending into the rearward chamber of the gun body, and a second inlet passageway extending into the forward chamber of the gun body. The pilot valve is slidable within the bore between a non-operating or normal position and an operating position, in response to depressing the trigger.

In the normal position, the pilot valve is operable to direct pressurized air from an air supply passageway formed in the handle through both of the first and second inlet passageways so as to equally pressurize both the forward and rearward chambers on either side of the piston head. With both sides of the piston head pressurized, the piston is urged forwardly so that the valve mounted on the piston rod seats firmly against the nozzle and seals its discharge opening. By depressing the trigger, the pilot valve is moved to an exhaust or operating position wherein it is operable to exhaust air from the rearward chamber of the body through an air exhaust opening formed in the handle. This creates a sudden drop in pressure behind the piston head, causing the pressurized air in the forward chamber to force or snap the piston rearwardly and unseat the valve from the nozzle. In turn, the pressurized air within the forward chamber slams through the opened discharge opening in the nozzle and directly into an obstructed drain line, creating a drain cleaning shock wave. Pressurized air returns the pilot valve to its normal, non-operating position upon release of the trigger.

One important advantage of this invention over prior art drain cleaning devices of the type described above is that a relatively small force is required to depress the trigger and thereby initiate the release of pressurized air through the nozzle discharge opening. The piston herein is moved by the sudden pressure drop in the rearward chamber behind the piston head and the resulting rearward force on the front of the piston head applied by the pressurized air in the forward chamber. This is in contrast to prior art devices wherein a trigger mechanism is mechanically coupled directly to the piston. To retract the piston in such prior art devices, the trigger mechanism must be pulled with a force sufficient to overcome the pressure applied by the pressurized air in the chamber acting against the piston, and, in some cases, the additional force applied by a biasing spring.

The relatively small force required to depress the trigger of this invention ensures that a high pressure impulse of air is quickly discharged to the clogged drain line. The piston is easily and quickly retracted to immediately unseat the valve from the discharge orifice, thus avoiding the gradual pressure drop often present in prior art devices whose triggering mechanisms required a relatively large activating force, and discharge valve movement was manually, rather than pneumatically, accomplished. The apparatus herein is quickly reset for another burst of air by simply releasing the trigger and allowing the chambers to become pressurized.

In the presently preferred embodiment, pressurized, operating air is supplied to the chambers of the gun body through an air inlet line connected to the air supply passageway of the handle. This provides a constant supply of operating air at the desired pressure and permits rapid recycling of the gun body so that repeated bursts of air can be directed into the clogged drain line. It is also contemplated that the supply passageway in the handle could be adapted to receive a carbon dioxide cartridge for supplying the operating fluid to the gun body. In that embodiment, piercing means are incorporated in the handle to release the carbon dioxide from the container in preparation for operation of the gun.

In another aspect of this invention, a splash guard and cone are fitted to the exterior of the end cap mounted to the gun body. The splash guard is preferably a disk of flexible, elastomeric material which is adapted to fit over the opening of the drain line, such as a sink drain, to prevent water from the column behind the obstruction from splashing back onto the operator. The cone, which is spaced forwardly of the splash guard and holds it in place on the end cap, is shaped to fit within the opening of the drain line so as to guide the burst of pressurized air directly into the drain line with minimal leakage.

DESCRIPTION OF THE DRAWINGS

The structure, operation and advantages of a presently preferred embodiment of this invention will become further apparent upon consideration of the following description taken in conjunction with the accompanying drawings wherein.

DETAILED DESCRIPTION OF THE INVENTION

Figure 1:
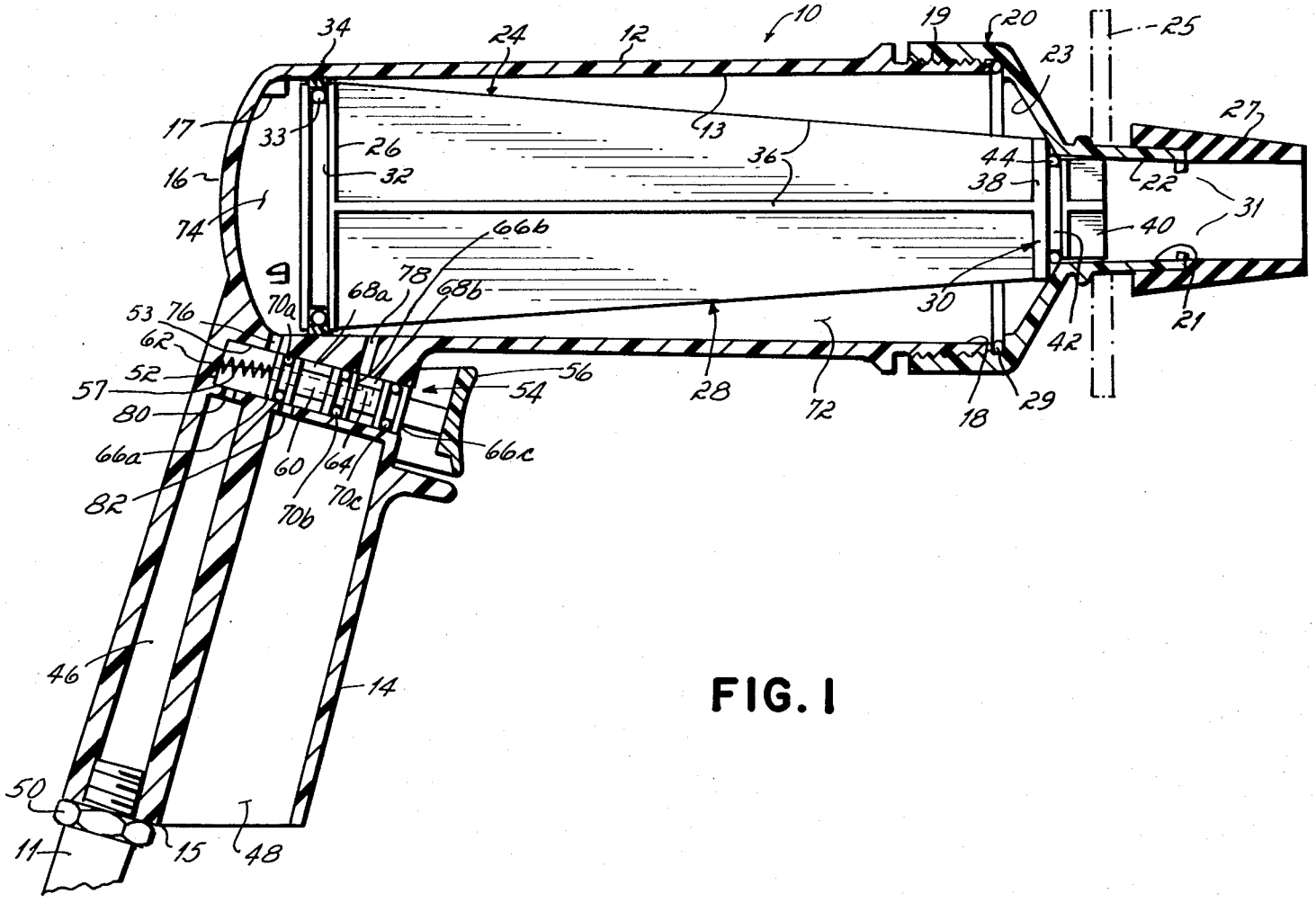
FIG. 1 is a side, elevational view in partial cross section showing the drain cleaning device of this invention in a normal, non-operating position.

Referring now to the drawings, a drain cleaning apparatus 10 according to this invention is formed in the shape of a gun having a hollow housing or gun body 12 connected to a pistol grip handle 14. The gun body 12 is generally cylindrical and comprises an inner wall 13, a closed rearward end 16 having an internal stop or shoulder 17, and an open forward end 18 formed with external threads as at 19. An end cap 20 threadedly engages the forward end 18 of gun body 12 and is sealed thereto by an O-ring 29. The end cap 20 tapers radially inwardly relative to the forward end 18 to form a nozzle 22 having a discharge opening 21 and a tapered sidewall 23, both of which extend outwardly from the forward end 18 of gun body 12.

In a presently preferred embodiment, the apparatus 10 also includes a splash guard 25 insertable over the nozzle 22, and a cone 27 which holds the splash guard 25 in place on nozzle 22. The splash guard 25 is preferably about 4–5 inches in diameter and formed of a flexible material such as elastomer. The splash guard 25 is adapted to fit over and seal the entrance to a drain line (not shown), such as a sink drain cover, so as to prevent standing water in the column behind an obstruction in the drain line from splashing back against the operator. The cone 27 is shaped to conform to the entrance of the drain line to direct a high pressure burst of pressurized air therein with minimum leakage, as described below. A pair of projections 31, spaced 180° apart, are mounted on the interior wall of end cap 20 at the forward end of nozzle 22. The projections 31 prevent pressure from building up behind an article jammed into the nozzle 22, so that the article cannot be shot out of the apparatus 10.

A piston 24 is slidably disposed within the gun body 12 and includes a piston head 26 connected to an elongated piston rod 28 having a discharge valve 30 at its forward end. The piston head 26 is formed with a recess 32 which receives an O-ring 33 and a generally rectangular-shaped piston ring 34 which overlies the O-ring 33. Preferably, the piston ring 34 is formed of a Teflon-graphite mixture and sealingly engages the inner wall 13 of body 12.

The piston rod 28 tapers radially inwardly from piston head 26 to its forward end. Preferably, the piston rod 28 is formed in an X-shape from a rigid plastic material having four interconnected vanes or flutes 36 which are spaced approximately 90° apart. It is contemplated that the piston rod 28 could be formed as a solid cross section, but the spaced flutes 36 provide the necessary strength and reduce the overall weight of piston rod 28. The other parts of apparatus 10, including the gun body 10, handle 14 and piston head 26, are also preferably formed of a rigid, molded plastic.

The piston rod 28 is connected at its forward end to discharge valve 30 which includes a flange 38 connected to a plug 40 with a recess 42 formed therebetween which receives an O-ring 44. In the non-operating or normal position of piston 24, discussed in detail below and shown in FIG. 1, the discharge valve 30 is adapted to seat against the tapered sidewall 23 of the nozzle 22 and seal its discharge opening 21. Specifically, the flange 38 contacts the tapered sidewall 23 of nozzle 22 and the plug 40 extends within the discharge opening 21 so that the O-ring 44 is compressed against the tapered sidewall 23 forming a fluid-tight seal therebetween.

The handle 14 is formed with an air supply passageway 46 and a fluid exhaust passageway 48, both of which extend axially along the handle 14 from its base 15 toward the gun body 12. As shown in the figures, the air supply passageway 46 is disposed at the back of the handle 14, and its lower end receives a fitting 50 for an air hose 11. Although the location of supply and exhaust passageways 46, 48 could be reversed, it is preferable to position the supply passageway 46 at the back of the handle 14 so that the air hose 11 does not interfere during a cleaning operation. In addition, it is contemplated that the air hose 11 could be replaced with a cartridge of carbon dioxide or other pressurized fluid fitted within the supply passageway 46 in handle 14. In that embodiment, the handle 14 is provided with conventional means (not shown) to pierce the pressurized fluid container and release its contents.

A transverse bore 52 is formed in the handle 14 between the upper ends of supply and exhaust passageways 46, 48 and the gun body 12. The transverse bore 52, forming an inner wall 53 in handle 14, receives a pilot valve 54 which is slidable therealong by operation of a trigger 56 connected to the pilot valve 54 and disposed exteriorly of the handle 14. A spring 57 is mounted between the innermost ends of the pilot valve 54 and transverse bore 52 to bias the pilot valve 54 and trigger 56 outwardly when not in operation. The pilot valve 54 includes a cylindrical body formed with an internal passageway 60 having an inlet port 62 and an outlet port 64. Three spools **66*a–c* are spaced along the exterior surface of the pilot valve body 58 forming recesses 68*a*, 68*b* therebetween. Each of the spools 66*a–c* is formed with a groove which receives an O-ring 70*a–c*, respectively, which sealingly engage the inner wall 53 formed by transverse bore 52**.

As shown in the Figs., the piston head 26 divides gun body 12 into a forward chamber 72 extending between the front of piston head 26 and nozzle 22, and a rearward chamber 74 extending between the back of piston head 26 and the rearward end 16 of gun body 12. A first passageway 76 interconnects the rearward chamber 74 with the transverse bore 52 in handle 14. The forward chamber 72 is connected to the transverse bore 52 by a second passageway 78. A supply port 80 connects air supply passageway 46 with the transverse bore 52, and the exhaust passageway 48 is connected to transverse bore 52 by an exhaust port 82.

The operation of apparatus 10 in ejecting a high pressure impulse of air into a drain line (not shown) for removing an obstruction is as follows. The air hose 11 delivers air at a pressure of preferably up to 100 psi through the supply passageway 46 and into the transverse bore 52. In order to develop air pressure within the gun body 12 necessary to release a high pressure impulse of air, the pilot valve 54 is initially positioned in a first or normal position as shown in FIG. 1. In the normal position, the innermost spool **66*a* is spaced between the first passageway 76, which leads to the rearward chamber 74, and the exhaust port 82 which connects to the exhaust passageway 48 in handle 14. The second passageway 78, leading to forward chamber 72, is positioned in the recess 68*b* between spools 66*b*, 66*c* and in general alignment with the outlet port 64 of the internal passageway 60 formed in the valve body 58. Pressurized air delivered through supply passageway 46 thus flows through supply port 80, into transverse bore 52 and then directly through first passageway 76 to the rearward chamber 74**.

At the same time, air enters the internal passageway 60 in pilot valve 54 through its inlet port 62 and exits through the outlet port 64 into recess **68*b*. From the recess 68*b*, the air flows into forward chamber 72 through second passageway 78**.

The forward and rearward chambers 72, 74 are therefore pressurized simultaneously with the same line pressure from air hose 11. The pressurized air in forward chamber 72 applies a force against the valve 30 urging it forwardly toward nozzle 22, and a force against the front side of piston head 26 urging it rearwardly toward the rearward end 16 of gun body 12. The force exerted against the front of piston head 26 is opposed a force applied to the back of piston head 26 by the pressurized air in rearward chamber 74. Since the forces exerted against the piston head 26 are substantially equal, and the force exerted against the valve 30 by the pressurized air in forward chamber 72 urges it forwardly, the resultant force on piston 24 is in the forward direction which seats the valve 30 against the tapered sidewall 23 of nozzle 22 so that its discharge opening 21 is sealed fluid-tight.

Figure 2:
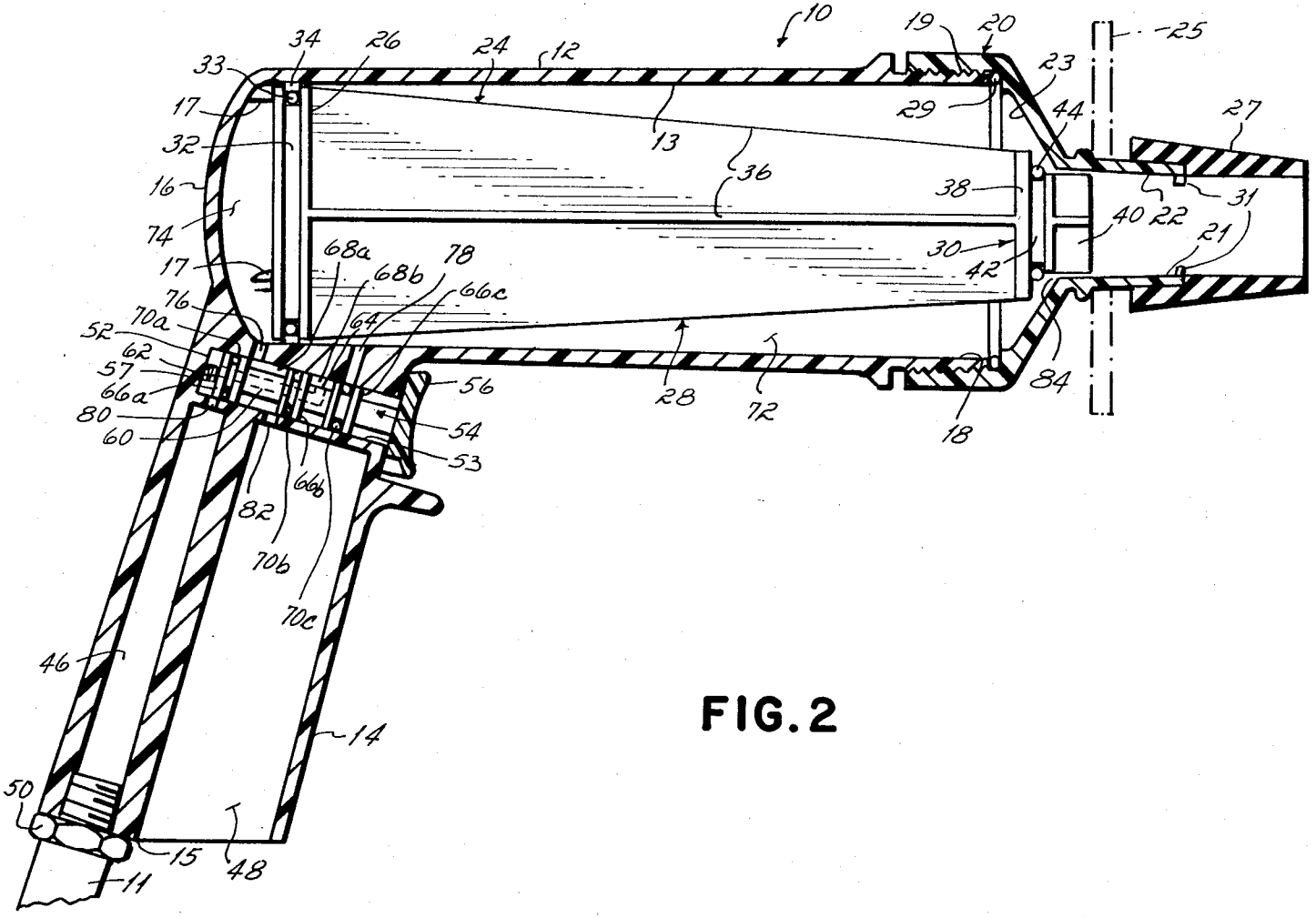
FIG. 2 is a view similar to FIG. 1 after the release of a burst of pressurized air into a drain line.

The pilot valve 54 is movable to a second or operating position by depressing trigger 56. As shown in FIG. 2, with the trigger 56 depressed the pilot valve 54 is slid inwardly along the transverse bore 52. In this position, the innermost spool **66*a* is positioned along transverse bore 52 in general alignment with the supply inlet port 80, and the first passageway 76 leading to rearward chamber 74 aligns with the recess 68*a* between spools 66*a*, 66*b*. In addition, the spool 66*c* at the opposite end of pilot valve 54 essentially covers the second passageway 78 leading to forward chamber 72**.

Once the innermost spool **66*a* moves inwardly of the first passageway 76, the recess 68*a* interconnects the first passageway 76 with the exhaust passageway 48 in handle 14 through exhaust port 82. This results in the immediate release or exhaust of pressurized air from the rearward chamber 74. Since the forward chamber 72 is essentially sealed from the transverse bore 52 by spool 66*c*, pressure is maintained in forward chamber 72 at the instance of the pressure drop in rearward chamber 74. Once air is exhausted from the rearward chamber 74, the pressurized air in forward chamber 72 immediately forces the piston 24 rearwardly so that piston head 26 engages the shoulder 17 formed in rearward end 13 of the gun body 12. This sudden rearward movement of piston 24 quickly unseats the valve 30 from the nozzle 22 forming a space 84 therebetween through which pressurized air in forward chamber 72 can pass for movement through the discharge opening 21. A high pressure sudden impulse of air is thus produced virtually instantaneously with the movement of pilot valve 54, and is released into discharge opening 21, through the cone 27 connected to end cap 20** and then directly into a drain line (not shown).

One important advantage of this invention is that the movement of pilot valve 54 which effects the release of a high pressure impulse of air from the forward chamber 72 is accomplished with minimal force. As described above, movement of the piston 24 is achieved by creating a pressure drop in rearward chamber 74 while maintaining pressure in forward chamber 72, so that the piston 24 is forced rearwardly by the pressurized air in forward chamber 72 which is then released into nozzle 22. While the pressurized air entering transverse bore 52 applies a force against the pilot valve 54 which resists its inward movement, the diameter of the pilot valve 54 is small, and therefore the applied force is minimal. The trigger 56 may thus be easily and quickly depressed so that movement of the piston 24 as described above occurs immediately to assure the release of a high pressure impulse of air.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. Apparatus for discharging a high pressure burst of fluid into a drain line to remove an obstruction therefrom, comprising:

a hollow housing having a first chamber formed with a fluid discharge opening at a forward end of said housing, and a second chamber disposed at a rearward end of said housing;

first valve means disposed within said first chamber at said forward end of the housing, said first valve means being movable between a closed and an open position, said first valve means sealing said fluid discharge opening in said closed position and unsealing said fluid discharge opening in said open position;

second valve means operatively communicating with said first and second chambers, said second valve means being movable between a first position and a second position;

said second valve means being operable in said first position to pass fluid under pressure into said first and second chambers, said first valve means being moved to said closed position with said first and second chambers pressurized to seal said fluid discharge opening;

said second valve means being operable in said second position to exhaust pressurized fluid from said second chamber while maintaining pressurized fluid in said first chamber; and said first valve means being moved to said open position upon the exhaust of pressurized fluid from said second chamber to unseal said fluid discharge opening and release pressurized fluid from said first chamber therethrough and into a drain line.

2. The apparatus of claim 1 further including a piston means extending from said second chamber at a rearward end of said housing forwardly to said forward end of said housing and being axially movable within said housing, said piston having a head portion and a piston rod connected to said first valve means, said head portion dividing said housing into said first and second chambers.

3. Apparatus for discharging a high pressure burst of air into a drain line to remove an obstruction therefrom, comprising:

a hollow housing including a forward end having a discharge opening, said forward end being adapted to communicate with a drain line, said housing having a rearward end;

piston means axially movable within said housing, said piston means having a head portion forming a forward chamber and a rearward chamber in said housing at a rearward end thereof;

first valve means disposed within said forward chamber at said forward end of said housing and connected to said piston means, said first valve means being axially movable with said piston means between a closed position to seal said discharge opening and an open position to unseal said discharge opening;

second valve means communicating with said forward and rearward chambers, said second valve means being movable between a first and second position;

said second valve means being operable in said first position to pass pressurized air into said forward and rearward chambers, said first valve means being movable forwardly with said piston means to said closed position to seal said discharge opening with said second valve means in said first position and said forward and rearward chambers pressurized;

said second valve means being operable in said second position to exhaust pressurized air from said rearward chamber, said first valve means being movable rearwardly with said piston means to said open position to unseal said discharge opening with said second valve means in said second position so that pressurized air from said forward chamber is released through said opened discharge opening and into a drain line.

4. The apparatus of claim 3 in which said piston includes a stem connected to said head portion, said stem being formed with an X-shaped cross section having four rib sections connected together approximately 90° apart.

5. The apparatus of claim 3 further including an end cap mounted to said housing, said end cap having a nozzle formed with said discharge opening, and having at least one projection extending into said discharge opening for preventing a build up of pressure behind a foreign object placed into said discharge opening.

6. The apparatus of claim 5 in which said end cap is formed with a tapered inner wall, said first valve means being movable in said closed position to engage said tapered wall for sealing said discharge opening, said first valve means being movable in said open position to disengage said tapered wall and open said discharge opening.

7. The apparatus of claim 3 in which said piston means includes a piston rod connected to said head portion, and extending from a rearward end of said housing to a forward end thereof adjacent said discharge opening, said first valve means having a flange connected to a plug, said flange and plug being mounted to said piston rod for axial movement therewith to open and close said discharge opening.

8. Apparatus for discharging a high pressure burst of air into a drain line to remove an obstruction therefrom, comprising:

a gun body including a forward end and a discharge opening disposed at said forward end;

a pistol grip handle connected to said gun body, said handle being formed with a transverse bore connected to an air inlet passageway and an air exhaust passageway;

a piston axially movable within said gun body, said piston having a piston head connected to a piston rod, said piston head dividing said gun body into a forward and a rearward chamber;

first valve means disposed within said forward chamber at said forward end of said gun body and connected to said piston rod, said first valve means being axially movable with said piston between a closed position to seal said discharge opening and an open position to unseal said discharge opening;

a first passageway formed between said transverse bore and said rearward chamber, and a second passageway formed between said transverse bore and said forward chamber;

second valve means slidable within said transverse bore between a first and second position;

said second valve means being operable in said first position to pass air under pressure from said air inlet passageway through said first and second passageways and into said forward and rearward chambers, said first valve means being movable forwardly with said piston to said closed position to seal said discharge opening with pressurized air in each of said forward and rearward chambers;

said second valve means being operable in said second position to exhaust pressurized air from said rearward chamber through said first passageway and into said air exhaust passageway while maintaining pressurized air in said forward chamber, said first valve means being moved rearwardly with said piston to said open position to unseal said discharge opening with pressurized air exhausted from said rearward chamber, the pressurized air from said forward chamber being released through said discharge opening with said first valve means in said open position and into a drain line.

9. The apparatus of claim 8 in which said second valve means is a pilot valve including:

a cylindrical body formed with an internal passageway having an inlet port and an outlet port;

spools spaced along the exterior surface of said cylindrical body and forming recesses therebetween, said spools being adapted to seal against the inner wall of said transverse bore;

said cylindrical body being movable relative to said first and second passageways to direct pressurized air therethrough in said first position, and to exhaust pressurized air from said rearward chamber through said second passageway in said second position.

10. The apparatus of claim 8 further including an end cap connected to said forward end of said gun body, said end cap having a nozzle formed with said discharge opening.

11. The apparatus of claim 10 further including a cone connected to said end cap, said cone being shaped for insertion into an open end of a drain line.

12. The apparatus of claim 10 further including a splash plate mounted to said end cap, said splash plate being formed to seal an opening of a drain line.

* * * * *